US006260730B1

(12) United States Patent
Fellman

(10) Patent No.: US 6,260,730 B1
(45) Date of Patent: Jul. 17, 2001

(54) PAINTING SYSTEM WITH INTERCHANGEABLE LINER FOR PAINT CONTAINER

(76) Inventor: Marvin N. Fellman, 6764 Pansy Dr., Miramar, FL (US) 33023

( * ) Notice: Subject to any disclaimer, the term of this patent is extended or adjusted under 35 U.S.C. 154(b) by 0 days.

(21) Appl. No.: 09/585,480

(22) Filed: Jun. 2, 2000

(51) Int. Cl.[7] ..... B65D 25/00

(52) U.S. Cl. ..... 220/495.02; 220/23.83; 220/695

(58) Field of Search ..... 220/23.83, 495.02, 220/23.91, 528, 695, 700

(56) References Cited

U.S. PATENT DOCUMENTS 1,466,084 * 8/1923 Burrows ..... 220/495.02
1,590,572 * 6/1926 Fredette ..... 220/700 X
2,988,767 * 6/1961 Tretwold et al. ..... 220/695 X
4,122,973 * 10/1978 Ahern ..... 220/495.02
5,400,916 * 3/1995 Weber ..... 220/495.02
5,549,216 * 8/1996 Scholl ..... 220/695
5,893,489 * 4/1999 Giarrante ..... 220/695 X

* cited by examiner

*Primary Examiner*—Steven Pollard
(74) *Attorney, Agent, or Firm*—M. K. Silverman

(57) ABSTRACT

An interchangeable liner for a paint container constitutes a semi-rigid unitary liner having a mouth, a basin portion proportioned for conformal engagement with a solid segment of an interior volume of the container. The liner also includes a circular top, including an outer attachment ring defining a lip proportioned for snap-fittable securement onto a circumferential lip of said paint container, with such liner, one type of paint may be held in it, while a second paint or painter's liquid is held within the paint container proper.

4 Claims, 3 Drawing Sheets

PAINTING SYSTEM WITH INTERCHANGEABLE LINER FOR PAINT CONTAINER

BACKGROUND OF THE INVENTION

This invention relates to a liner for paint containers which allows re-use of one paint container while changing color of the paint therein solely by changing the liner of the container. This invention thereby provides a significant improvement in that a person can use the same paint container changing paint colors by simply changing liners.

Painters rely on the size and weight of paint containers to facilitate indication of the paint applicator easily without a minimum of spilling of the paint. To change paint colors in a paint container without changing the entire paint container and thereby losing the container's advantages of size and weight, the plastic liner can be inserted into an empty or dirty paint container with a color different from the paint color container in that container. The plastic liner will lock into place on the outside lip at the upper circumferential top common to paint containers, thus becoming an integrated part of the container, taldng advantage of an optimal size and weight thereof.

As such, an interchangeable plastic liner to a paint container which facilitates changing paint colors and not having to clean the original container thus saving time and labor, while still maintaining the size and weight advantages of the original paint container is highly desirable.

U.S. Pat. No. 5,236,102 issued to Quittman et al. describes a reusable container composed of a container and an insert to the container's body. The insert is completely form fitting to the container and is not secured to the container in any fashion, merely remaining in place through gravity. The insert is removable and is made of some type of biologically decomposable material or ultraviolet light degradable material.

U.S. Pat. No. 5,258,086 to Hale describes a reusable recyclable fiber drum with a detachable lining secured into place through rings which secure the ends of the drum onto the drum itself. Here, the liner is form fitting to the circular body of the drum and secured through the rings which hold the ends of the drum to the drum, external to the shape of the liner.

U.S. Pat. No. 5,014,872 to Robbins, describes sleeved containers with a thin film lining. Here, the container has a rectangular body and the liner, which is a thin film lining, soft and malleable. The liner is held into place through bracing external to itself, with a rigid form-fitting top brace, rectangular in shape. Said brace fits inside the rigid top brace of the liner, holding the liner within the container.

None of these, nor other, references known to the inventor address the problem solved by the instant liner because the instant liner contains its own means of attachment to a container, as well as its ability to maintain its own shape without external bracing from a container. Here the instant liner is self-attaching to the paint container through its attachment ring and lip. The instant liner is also rigid and maintains its shape without aid from the container which it is attached to.

SUMMARY OF THE INVENTION

The present invention relates to an interchangeable liner for a paint container. It more particularly constitutes a semi-rigid unitary liner having a mouth, a basin portion proportioned for conformal engagement with a solid segment of an interior volume of the container, the liner also including a circular top, including an outer attachment ring defining a lip proportioned for snap-fittable securement onto a circumferential lip of said paint container.

It is an object of the invention to enable one to change paint colors within a paint container without emptying paint of a different color already occupying a part of the volume of the container.

It is another object to provide a means for re-use of a paint container by preclusion of contact by any paint of the interior surface of the paint container.

It is a yet further object to provide a means of easily changing paint colors without requirement to use or clean plurality of different buckets.

The above and yet other objects and advantage of the present invention will become apparent from the hereinafter set forth Brief Description of the Drawings, Detailed Description of the Invention and Claims appended herewith.

DETAILED DESCRIPTION OF THE INVENTION

Figure 1:
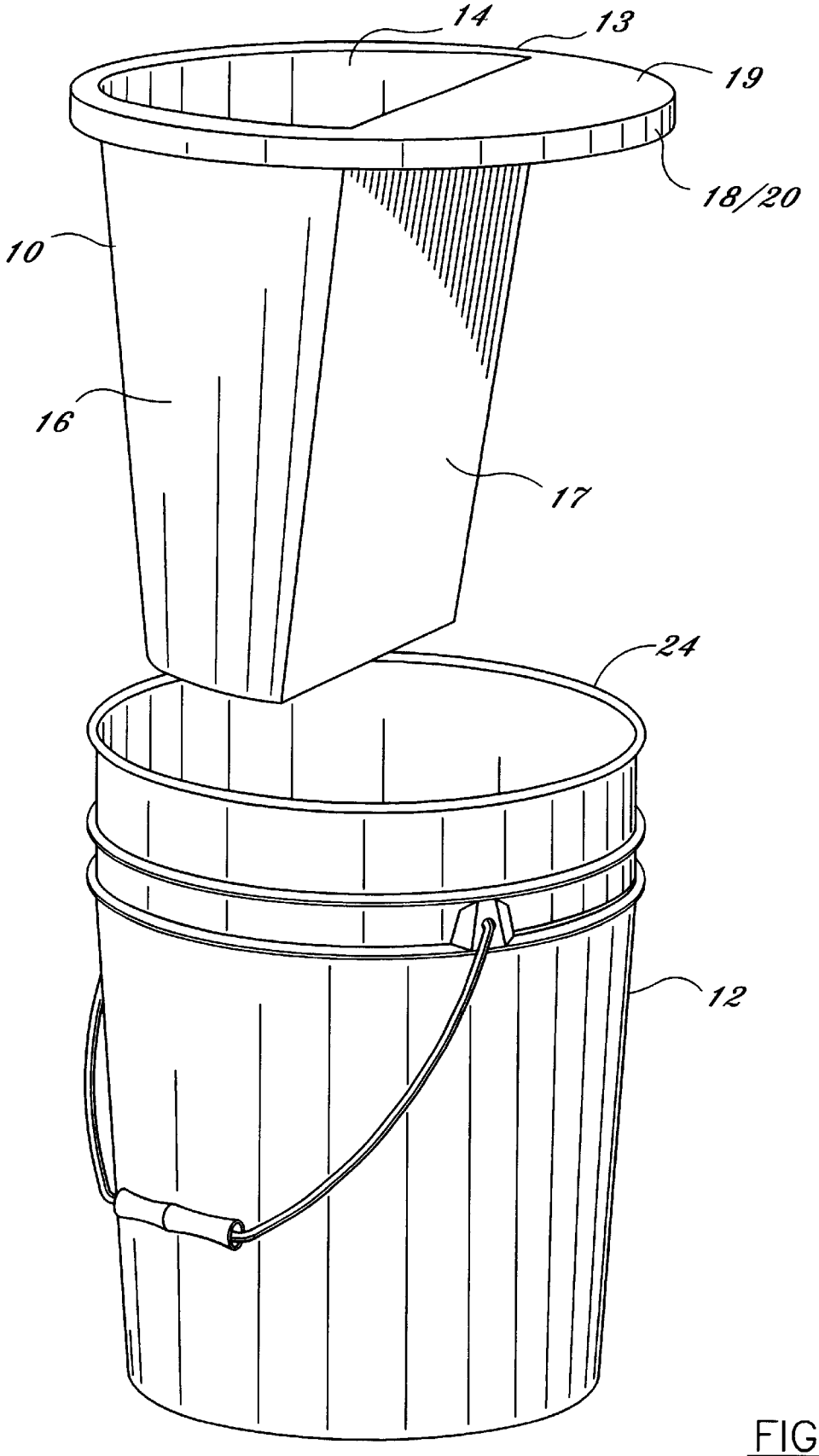
FIG. 1 is a perspective view of the inventive liner above a paint container into which it is to be inserted.
Figure 2:
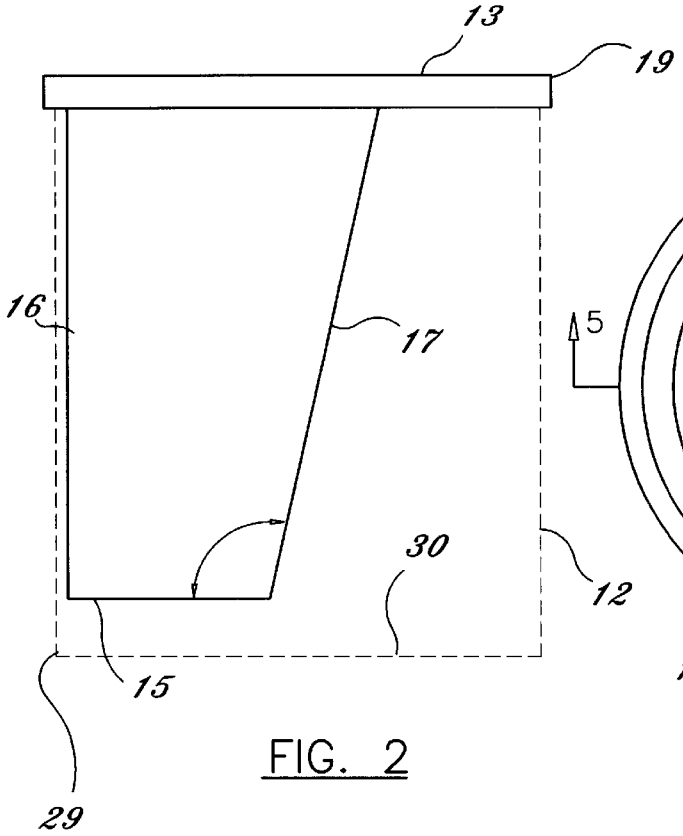
FIG. 2 is a schematic view of the liner nested in the paint container, and also showing the inclination of an inclined plane thereof to the other walls thereof.
Figure 5:
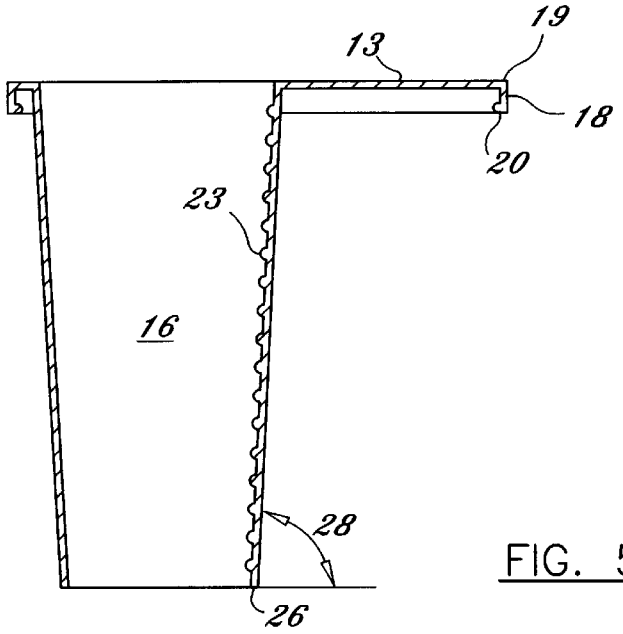
FIG. 5 is a side cross-sectional view of the liner, taken along Line 5—5 of FIG. 3, noting the semi-circular planar top with the attachment ring and lip thereof, the basin and inclined plane of the liner.
Figure 6:
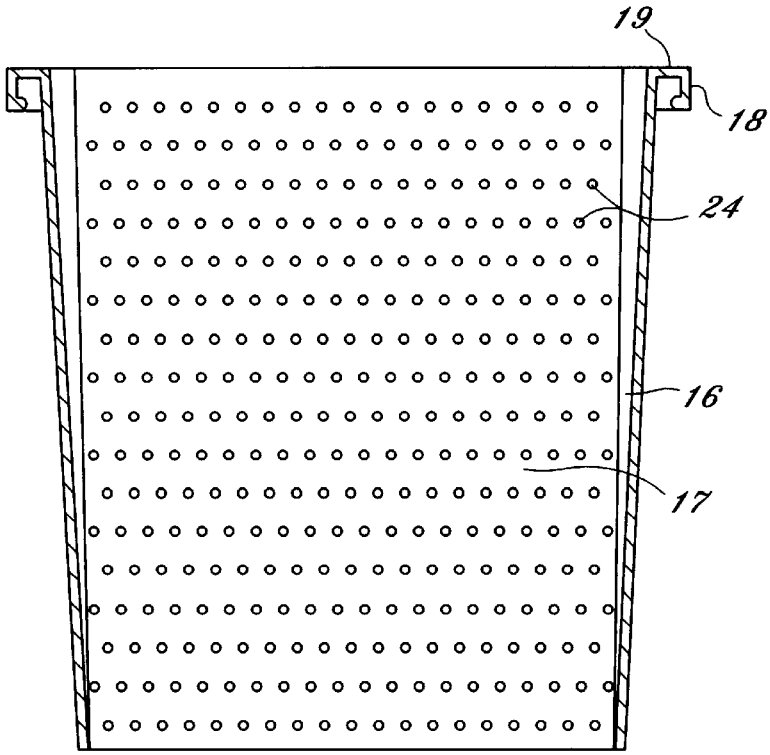
FIG. 6 is a front view, taken along Line 6—6 of FIG. 5, directly facing the inclined plane of the basin portion noting the protrusions on the inclined plane.

With reference to FIGS. 1, 2, and 5, a flexible liner 10 fits onto and inside of a paint container 12 and is made preferably from a recycled plastic, which thereby allows it to keep substantially its own form. The liner 10 includes a resilient male lip 20 depending from an attachment ring 18 which is securable to a top of the paint container 12. FIG. 1 illustrates the plastic liner 10 raised above the paint container 12.

Figure 3:
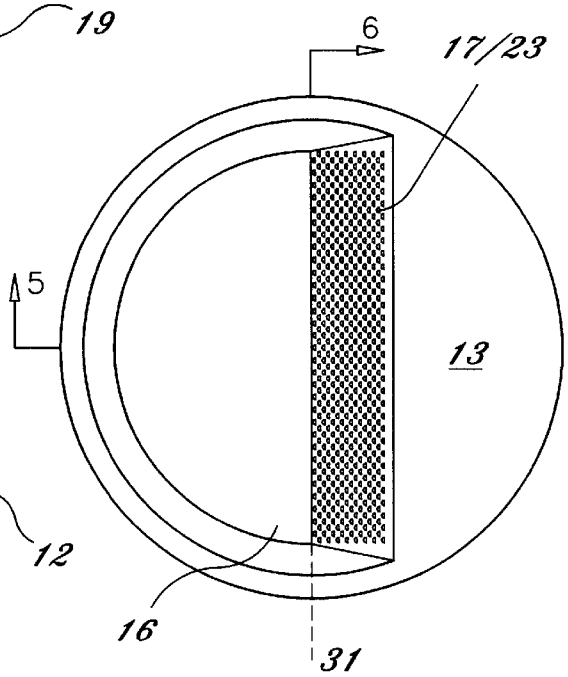
FIG. 3 is a top view of the plastic liner, noting the circular shape of the top, the semi-circular shape of the mouth and the protrusions on said inclined plane thereof.
Figure 4:
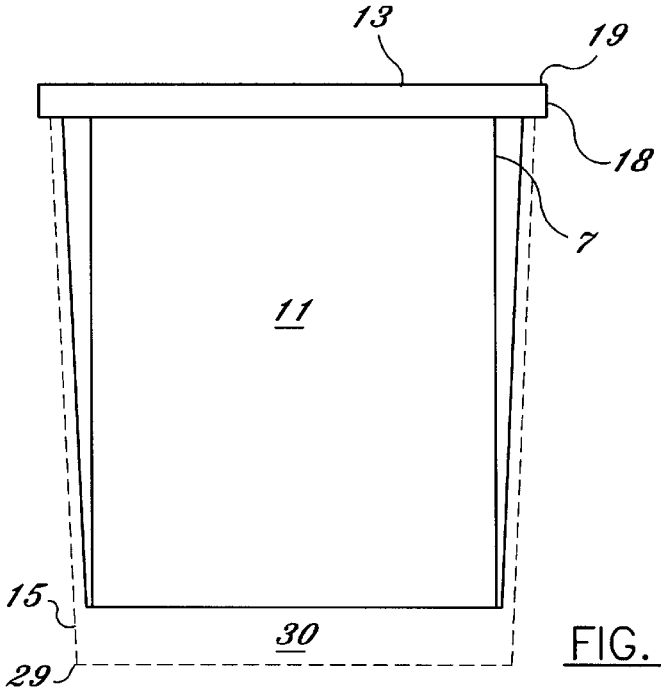
FIG. 4 is a rear view of the liner inserted into the paint container.

In FIGS. 1 to 3 the plastic liner may be seen to include a flat top 13 having a semi-circular mouth 14, a semi-circular solid basin 16, an inclined plane 17, a circular portion 15 of a basin 16, and said attachment ring 18. The top 13 of the liner exhibits a flat upper surface which is proportioned to accommodate a paint brush or roller thereon.

Said basin 16 of the liner 10 includes said inclined 17 plane having a less than 90 degree inclination from the top of the liner, with protrusions 23 on its upward surfaces. Said inclined plane 17 extends the entire height of the basin 16. The basin narrows as the inclined plane 17 reaches a bottom 26 of the basin 16 of the liner at an angle 28 which is in a range of 70 to 85 degrees. See FIGS. 2 and 3. Thus, the bottom of the basin starts at a diametric line 31 through the circular top causing the bottom to be a semi-circle of a smaller diameter than the circular mouth top 14.

The bottom 26 of the liner does not rest upon a bottom 29 of the paint container 12, leaving a small void 30 area remaining in the paint container 12. See FIG. 2. Therefore, the paint container has space available for other paint while the plastic liner is inserted. Thus, the paint container can hold paints of different colors simultaneously, one in the paint container 12 and one in the basin of the plastic liner 10.

Figure 7:
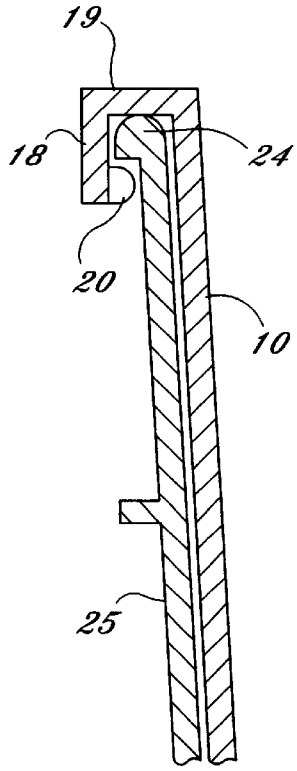
FIG. 7 is an enlarged cross-sectional view of the lip on the lower inside of the attachment ring situated along the outside edge of the liner, in complemental snap-fittable engagement to a common top edge of the paint container.

The attachment ring 18 on the outside edge of the top 13 of the plastic liner 10 facilitates attachment of the liner to the paint container through an outside lip 24 thereof. That is, as noted in FIG. 7, the liner may be snap-fittably attached to the outside lip 24 common to all paint containers. This may be accomplished as the plastic used to make the liner has a flexible but resilient nature, that is, returning to its original shape. Therefore a rigid connection can be accomplished through application of pressure on the ring 18 of the liner 10 in opposition to the wall of the paint container wall 25, causing an the attachment to complemental male lip snap 20, to bend over the outside container lip 24 below the attachment ring 18, this holding the liner to the container.

It is noted that incline plane 17 and the protrusions 23 thereof function as a means of (a) cleaning a paint brush or roller used with the present system, and (b) providing for even distribution of paint on the brush or roller.

Accordingly, while there has been shown and described the preferred embodiment of the invention, it is to be understood that the invention may be embodied otherwise than is herein specifically shown and described and that within said embodiments certain changes may be made in the form and arrangements of the parts without departing from the underlying ideas or principles of this invention as set forth in the Claims appended herewith.

Having thus described my invention what I claim as new, useful and non-obvious and, accordingly, secure by Letters Patent of the United States is:

1. A painting system comprising:

(a) a cylindrical paint container; and (b) an interchangeable liner therefore comprising a semi-rigid unitary body having a mouth, a basin proportioned for conformal engagement with at least a solid segment of an interior volume of said container, and a circular top integrally surrounding said mouth, said top including an outer attachment ring defining a lip proportioned for snap-fittable securement onto a circumferential lip of said paint container, in which said basin portion includes an inclined plane having one edge thereof in integral communication with said mouth of said semi-rigid body and having an opposite edge thereof in integral communication with a base of said basin portion of said unitary body, said inclined plane including a plurality of discreet protrusions across an external surface thereof.

2. The liner as recited in claim 1, in which said base of said basin portion defines a flat plane which does not extend to a bottom of the paint container.

3. The liner of claim 2, in which said circular top comprises a substantially flat planar portion dependent from said inclined plane thereof, and press-fittably securable to a semi-circumferential edge of said lip of said container.

4. The liner of claim 3, in which said circular top further comprises a substantially flat planar portion.

* * * * *